US010955172B2

(12) United States Patent
Liu et al.

(10) Patent No.: US 10,955,172 B2
(45) Date of Patent: Mar. 23, 2021

(54) HIGH-TEMPERATURE AIR CONDITIONING DEVICE

(71) Applicant: Gree Electric Appliances, Inc. of Zhuhai, Zhuhai (CN)

(72) Inventors: Hua Liu, Zhuhai (CN); Hongbo Li, Zhuhai (CN); Zhiping Zhang, Zhuhai (CN); Sheng Wang, Zhuhai (CN); Dongjun Sun, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 62 days.

(21) Appl. No.: 16/195,935

(22) Filed: Nov. 20, 2018

(65) Prior Publication Data

US 2019/0086124 A1 Mar. 21, 2019

Related U.S. Application Data

(63) Continuation of application No. PCT/CN2017/082143, filed on Apr. 27, 2017.

(30) Foreign Application Priority Data

Jun. 1, 2016 (CN) ..... 201610383204.7

(51) Int. Cl.

| | |
|---|---|
| ***F25B 1/00*** | (2006.01) |
| ***F25B 41/04*** | (2006.01) |
| ***F25B 41/00*** | (2006.01) |
| ***F25B 5/04*** | (2006.01) |
| ***F25B 31/00*** | (2006.01) |

(52) U.S. Cl.

CPC ..... *F25B 1/00* (2013.01); *F25B 5/04* (2013.01); *F25B 31/006* (2013.01); *F25B 41/00* (2013.01); *F25B 41/04* (2013.01); *F25B 2341/0012* (2013.01); *F25B 2341/066* (2013.01)

(58) Field of Classification Search

CPC .... F25B 1/00; F25B 41/00; F25B 5/04; F25B 31/006; F25B 41/04; F25B 2341/066; F25B 2341/0012; F25B 41/003

USPC ..... 62/498

See application file for complete search history.

(56) References Cited

FOREIGN PATENT DOCUMENTS

| | | | |
|---|---|---|---|
| CN | 205669895 | U | 11/2006 |
| CN | 205039220 | U | 12/2006 |
| CN | 102331045 | A | 1/2012 |
| CN | 103370583 | A | 10/2013 |
| CN | 103380014 | A | 10/2013 |
| CN | 204593934 | U | 8/2015 |
| CN | 105890210 | A | 8/2016 |
| EP | 1037001 | A2 | 9/2000 |
| JP | H11182948 | A | 7/1999 |
| JP | 2001153424 | A | 6/2001 |
| JP | 2007093100 | A | 4/2007 |
| JP | 2008057875 | A | 3/2008 |

(Continued)

*Primary Examiner* — Ana M Vazquez

(74) *Attorney, Agent, or Firm* — Kilpatrick Townsend & Stockton, LLP

(57) ABSTRACT

Disclosed is a high-temperature air conditioning device. By changing an arrangement mode of throttle valves, a pressure of refrigerant inside a low-pressure pipeline is made to be lower than a pressure of refrigerant inside a medium-pressure pipeline, thus ensuring that the refrigerant, used for cooling components, inside the low-pressure pipeline has a low pressure, thereby solving a problem in the prior art that a frequency converter, a motor and lubricating oil are not cooled sufficiently or cannot be cooled due to excessively high evaporation pressure.

5 Claims, 3 Drawing Sheets

(56) References Cited

FOREIGN PATENT DOCUMENTS

| | | | |
|---|---|---|---|
| JP | 2011047525 | A | 3/2011 |
| JP | 2014129904 | A | 7/2014 |
| WO | 2012114182 | A1 | 8/2012 |

HIGH-TEMPERATURE AIR CONDITIONING DEVICE

CROSS REFERENCE TO RELATED APPLICATIONS

This application is a continuation application of PCT Patent Application No. PCT/CN2017/082143, entitled "High-Temperature Air Conditioning Device", filed on Apr. 27, 2017, which claims priority to Chinese Patent Application No. 201610383204.7, entitled "High-Temperature Air Conditioning Device", filed on Jun. 1, 2016, the entire contents of which are incorporated herein by reference.

FIELD

The present disclosure relates to the field of air-conditioning, more particularly, to a high-temperature air conditioning device.

BACKGROUND

In a conventional air conditioning device, the temperature of the outflow chilled water of the evaporator is about 7° C. The frequency converter, the motor, the lubricating oil, etc. are often cooled by refrigerant, and the technical solution is as follows: the air conditioning device includes a compressor 01, a condenser 02, an evaporator 03, a first throttle valve 04, a second throttle valve 05, and components 06 to be cooled (such as a frequency converter, a motor, lubricating oil and so on), and its structure is shown in FIG. 1. The high-temperature and high-pressure liquid refrigerant is divided into two streams after flowing out of the condenser 02. One stream of liquid refrigerant (in pipeline a) flows through the first throttle valve 04 and becomes low-temperature and low-pressure refrigerant to flow into the evaporator 03 to refrigerate; the other stream of liquid refrigerant (in pipeline b) flows through the second throttle valve 05 and becomes low-temperature and low-pressure refrigerant to cool the frequency converter, the motor, the lubricating oil, etc., then flows into the evaporator 03; the low-temperature and low-pressure gaseous refrigerant flowing out of the outlet of the evaporator 03 flows into the compressor 01 and is compressed to be high-temperature and high-pressure gaseous refrigerant; then the high-temperature and high-pressure gaseous refrigerant flows into the condensation 02; and the process above is repeated.

However, as for some air conditioning devices, such as a high-temperature refrigeration device with chilled water, a heating pump device, etc., the evaporation temperature in the evaporator 03 is excessively high, which will cause the pressure of the high-temperature and high-pressure liquid refrigerant in the pipeline b to be excessively high after it flows through the second throttle valve 05, and cause the motor, the frequency converter and the lubricating oil not cooled sufficiently or not possible to be cooled.

At present, as for a high-temperature air conditioning device, especially for a high-temperature refrigerating device or for a high-temperature heating pump device, new refrigeration solutions need be found to cool the motor, the frequency converter, and the lubricating oil, so as to achieve a stable and reliable operation of the device.

SUMMARY OF THE DISCLOSURE

In view of this, the present disclosure provides a high-temperature air conditioning device, so as to solve the problem that the frequency converter, the motor, the lubricating oil are insufficiently cooled or not possible to be cooled due to excessively high evaporation pressure. disclosure In some embodiments, a high-temperature air conditioning device includes a compressor, a condenser, a throttling and cooling pipeline assembly, and an evaporator, which are connected in sequence to form a cycle; the throttling and cooling pipeline assembly includes throttle valves, a medium-pressure pipeline, a low-pressure pipeline, and a booster pipeline; the throttle valves are configured to enable a pressure of refrigerant in the low-pressure pipeline to be lower than a pressure of refrigerant in the medium-pressure pipeline; the medium-pressure pipeline and the low-pressure pipeline are connected in parallel; components to be cooled are disposed in the low-pressure pipeline; an outlet of the low-pressure pipeline is connected to the booster pipeline, and an outlet of the booster pipeline is connected to the evaporator; and a boosting device is arranged in the booster pipeline.

In one embodiment, the medium-pressure pipeline and the low-pressure pipeline are connected in parallel between the condenser and the evaporator;

throttle valves include a first throttle valve disposed in the medium-pressure pipeline, and a second throttle valve disposed in the low-pressure pipeline; and a pressure regulation capacity of the second throttle valve is greater than a pressure regulation capacity of the first throttle valve.

In one embodiment, throttle valves include a first throttle valve and a second throttle valve;

the medium-pressure pipeline and the low-pressure pipeline are connected in parallel, and the first throttle valve is arranged between the condenser, and an inlet of the medium-pressure pipeline and the low-pressure pipeline;

the second throttle valve is disposed in the low-pressure pipeline.

In one embodiment, the medium-pressure pipeline and the low-pressure pipeline are connected in parallel between the condenser and the evaporator;

throttle valves include a first throttle valve disposed in the medium-pressure pipeline, and a plurality of second throttle valves connected in series in the low-pressure pipeline; a pressure regulation capacity of the plurality of second throttle valves connected in series is greater than a pressure regulation capacity of the first throttle valve; the components to be cooled are connected in series downstream of the plurality of the second throttle valves.

In one embodiment, the pressure adjustment capability of each of the second throttle valves is identical.

In one embodiment, the number of the second throttle valves is two. In one embodiment, an inlet of the booster pipeline is connected to the outlet of the low-pressure pipeline; the boosting device is a booster pump.

In one embodiment, an inlet of the booster pipeline is connected to the condenser; the boosting device is an ejector; a high-pressure end of the ejector is connected to the condenser, and a low-pressure end of the ejector is connected to the evaporator; the outlet of the low-pressure pipeline is connected to an ejecting end of the ejector.

In some embodiments, in the high-temperature air conditioning device provided by the present disclosure, by changing the arrangement mode of the throttle valves, the pressure of the refrigerant in the low-pressure pipeline can be lower than the pressure of the refrigerant in the medium-pressure line, thereby ensuring that the refrigerant in the low-pressure pipeline, which is used for cooling the components, has a low pressure, and thereby solving the problem of insufficient cooling or impossible cooling due to excessively high evaporation pressure. The schemes are particularly suitable for the high-temperature refrigerating device or the high-temperature heating pump device.

DRAWINGS

In order to describe the embodiments of the present disclosure more clearly, the present disclosure will be described briefly with reference to the figures used in describing the embodiments FIG. 1 is a structural schematic view of the air conditioning device in the prior art;

Figure 1:
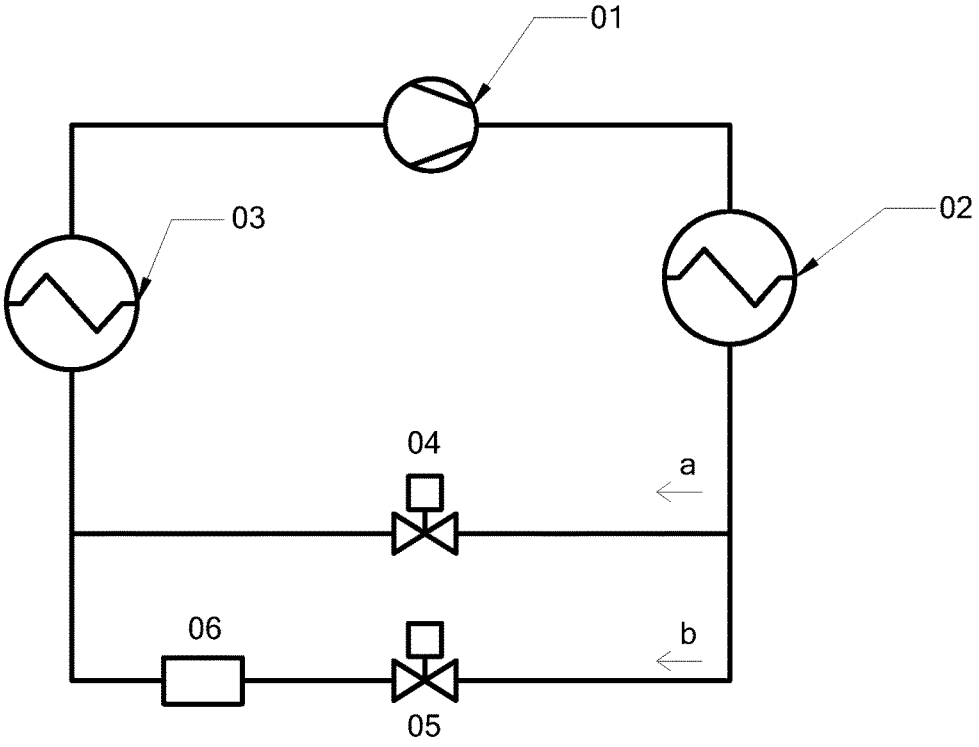
Fig.1 (Prior Art)

In FIG. 1 of the prior art, 01 indicates compressor, 02 indicates condenser, 03 indicates evaporator, 04 indicates first throttle valve, 05 indicates second throttle valve, 06 indicates components to be cooled;

In FIGS. 2 to 5 of the schemes of the present disclosure, 11 indicates compressor, 12 indicates condenser, 13 indicates evaporator, 14 indicates first throttle valve, 15 indicates second throttle valve, 16 indicates components to be cooled; 17 indicates booster pump, 18 indicates ejector.

DETAILED DESCRIPTION OF EMBODIMENTS

The present disclosure discloses a high-temperature air conditioning device, which is capable of solving the problem that the frequency converter, the motor, the lubricating oil are insufficiently cooled or not possible to be cooled due to excessively high evaporation pressure.

Embodiments of the present disclosure will be described clearly and in more details with reference to the accompanying figures. In some embodiments, what described below are several but not all embodiments of the present As for a high-temperature refrigerating device or for a high-temperature heating pump device, the refrigerant in the evaporator is medium-temperature and medium-pressure, so it is difficult to meet the requirements of cooling the frequency converter, the motor, and the lubricating oil only by employing one-stage isobaric throttling.

In view of this, one embodiment of the present disclosure provides a high-temperature air conditioning device, including a compressor 11, a condenser 12, a throttling and cooling pipeline assembly, and an evaporator 13, all of which are connected in sequence to form a cycle.

The main improvement is that the throttling and cooling pipeline assembly includes throttle valves, a medium-pressure pipeline, a low-pressure pipeline, and a booster pipeline;

The throttle valves are configured to enable the pressure of the refrigerant in the low-pressure pipeline to be lower than the pressure of the refrigerant in the medium-pressure pipeline. In the prior art, the refrigerant flowing out of the condenser is divided into two streams, which are throttled to have the same pressure. In the present scheme, one stream of the refrigerant in the low-pressure pipeline is throttled to have a lower pressure, so as to meet the cooling requirements of components 16 to be cooled (such as the motor, the frequency converter, the lubricating oil and so on).

The medium-pressure pipeline and the low-pressure pipeline are connected in parallel; components 16 to be cooled are disposed in the low-pressure pipeline.

The outlet the low-pressure pipeline is connected to the booster pipeline, and the outlet of the booster pipeline is connected to the evaporator 13; a boosting device is arranged in the booster pipeline. The refrigerant in the low-pressure pipeline is low-pressure, and at the same time, the refrigerant in the medium-pressure pipeline is medium-pressure, and the refrigerant in the evaporator 13 is medium-pressure, so the low-pressure refrigerant in the low-pressure pipeline cannot enter the evaporator 13 normally. In view of this, a booster pipeline is arranged to boost the pressure of the low-pressure refrigerant flowing out of the low-pressure pipeline, so that the low-pressure refrigerant is boosted to be the medium-pressure refrigerant, which can enter the evaporator 13 smoothly to cycle.

In one embodiment, in the high-temperature air conditioning device provided by the embodiment of the present disclosure, through changing the arrangement mode of the throttle valve, the pressure of the refrigerant in the low-pressure pipeline can be lower than the pressure of the refrigerant in the medium-pressure pipeline, which ensures that the refrigerant in the low-pressure pipeline, which is used to cool the components, is low-pressure, thereby solving the problem of insufficient cooling or non-cooling due to excessively high evaporation pressure in the prior art. This scheme is particularly applicable for the high-temperature refrigerating device or the high-temperature heating pump device.

This scheme provides two arrangement modes of the throttle valves and the pipelines, so as to obtain low-temperature and low-pressure refrigerant:

First, the medium-pressure pipeline and the low-pressure pipeline are connected in parallel between the condenser 12 and the evaporator 13.

Figure 2:
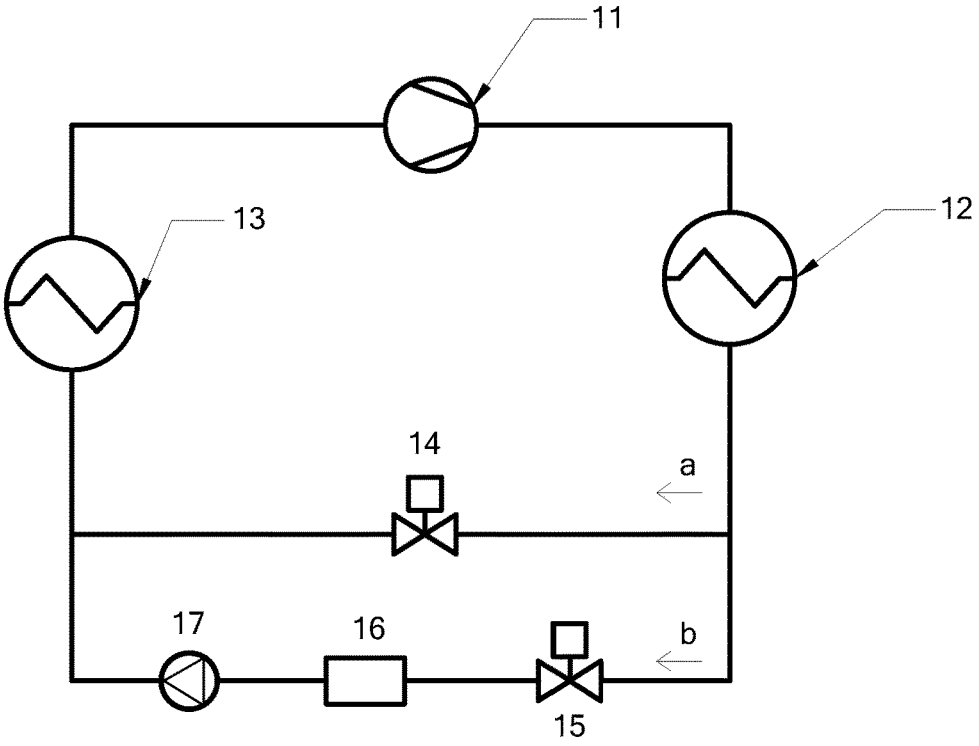
FIG. 2 is a structural schematic view of the high-temperature air conditioning device according to the first embodiment of the present disclosure.
Figure 3:
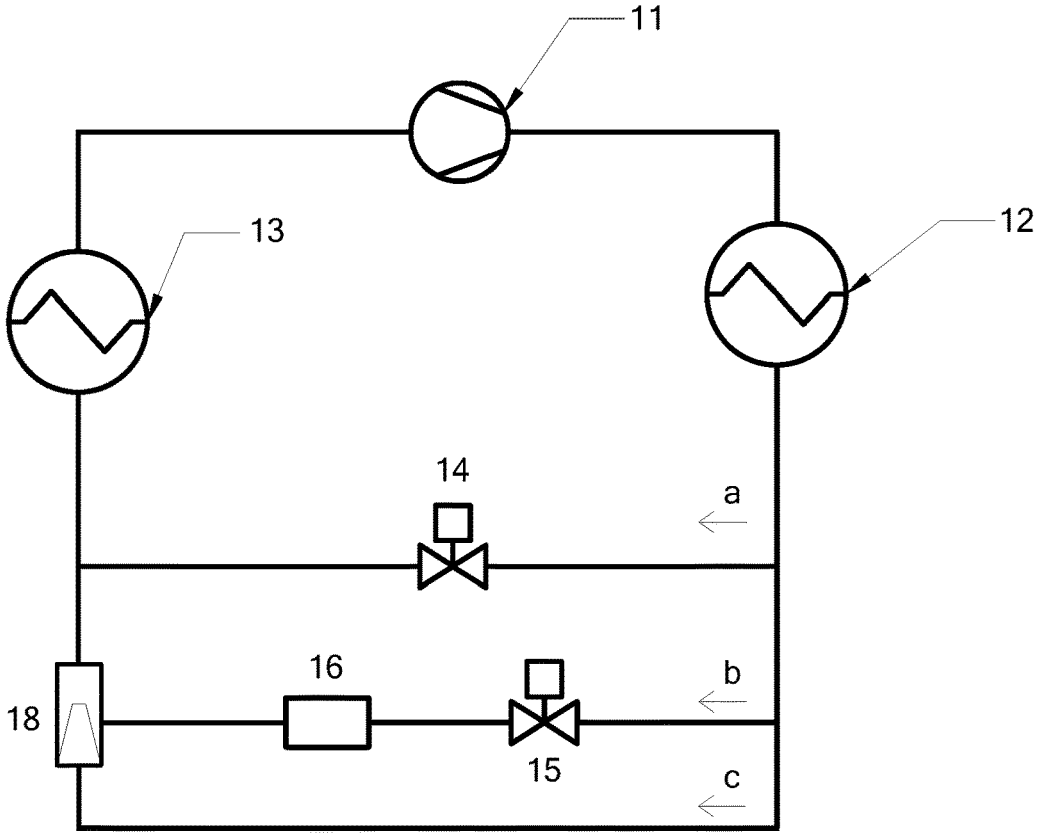
FIG. 3 is a structural schematic view of the high-temperature air conditioning device according to the second embodiment of the present disclosure.

The throttle valves include a first throttle valve 14 disposed in the medium-pressure pipeline, and a second throttle valve 15 disposed in the low-pressure pipeline. The pressure regulation capacity of the second throttle valve 15 is greater than the pressure regulation capacity of the first throttle valve 14. The components 16 to be cooled are connected in series downstream of the second throttle valve 15. The structures of two embodiments are shown in FIG. 2 and FIG. 3. That is to say, based on the structure of the air conditioning device in the prior art, two throttle valves with the same pressure regulation capacity in the two pipelines are improved to be one throttle valve with larger pressure regulation capacity, and the other throttle valve with smaller pressure regulation capacity, thereby achieving a medium-pressure pipeline (pipeline a) and a low-pressure pipeline (pipeline b) respectively. This mode makes a small change to the existing pipelines, and it is beneficial to realize and has simple structure.

Second, the throttle valves include the first throttle valve 14 and the second throttle valve 15.

The medium-pressure pipeline and the low-pressure pipeline are connected in parallel, and the first throttle valve 14 is arranged between the condenser 12 and an inlet of medium-pressure pipeline and the low-pressure pipeline. The structures of two embodiments are shown in FIG. 2 and FIG. 3.

The second throttle valve 15 is disposed in the low-pressure pipeline. That is to say, the high-temperature and high-pressure liquid refrigerant flowing out of the condenser 12 flows through the first throttle valve 14 and is throttled (in pipeline a), and becomes medium-temperature and medium-pressure refrigerant, which is further divided into two streams; one stream flows through the medium-pressure pipeline (pipeline b) and enters the evaporator 13 to refrigerate; the other stream flows through the low-pressure pipeline (pipeline c) and is throttled secondly by the second throttle valve 15, and the throttled low-temperature and low-pressure refrigerant is drawn into and cools the components 16 to be cooled (such as the frequency converter, the motor, the lubricating oil and so on).

In addition, a fine regulation can be made on the base of the first arrangement mode of the first throttle:

the medium-pressure pipeline and the low-pressure pipeline are connected in parallel between the condenser 12 and the evaporator 13, and the throttle valves include the first throttle valve 14 disposed in the medium-pressure pipeline, and a plurality of second throttle valves 15 connected in series in the low-pressure pipeline. The pressure regulation capacity of the plurality of second throttle valves 15 connected in series is greater than the pressure regulation capacity of the first throttle valve 14; the components 16 to be cooled are connected in series downstream of the plurality of the second throttle valves 15. That is to say, the throttle valve disposed in the low-pressure pipeline is replaced by a plurality of throttle valves connected in series, thus the refrigerant is throttled for many times by the plurality of throttle valves each with smaller pressure regulation capacity, thereby achieving the anticipated effects of replacing the single throttle valve with larger pressure regulation capability, and avoiding the drawbacks caused by throttling once and at a large scale.

In some embodiments, the pressure adjustment capability of each of the second throttle valves 15 is identical, and the entire throttling process is evenly divided into a plurality of segments; in addition, the same components are interchangeable, which facilitates assembly and maintenance.

In one embodiment provided by the present scheme, two second throttle valves 15 are provided, and a relatively simple structure can satisfy the cooling requirements of the components of the high-temperature refrigerating device or the high-temperature heating pump device.

Figure 4:
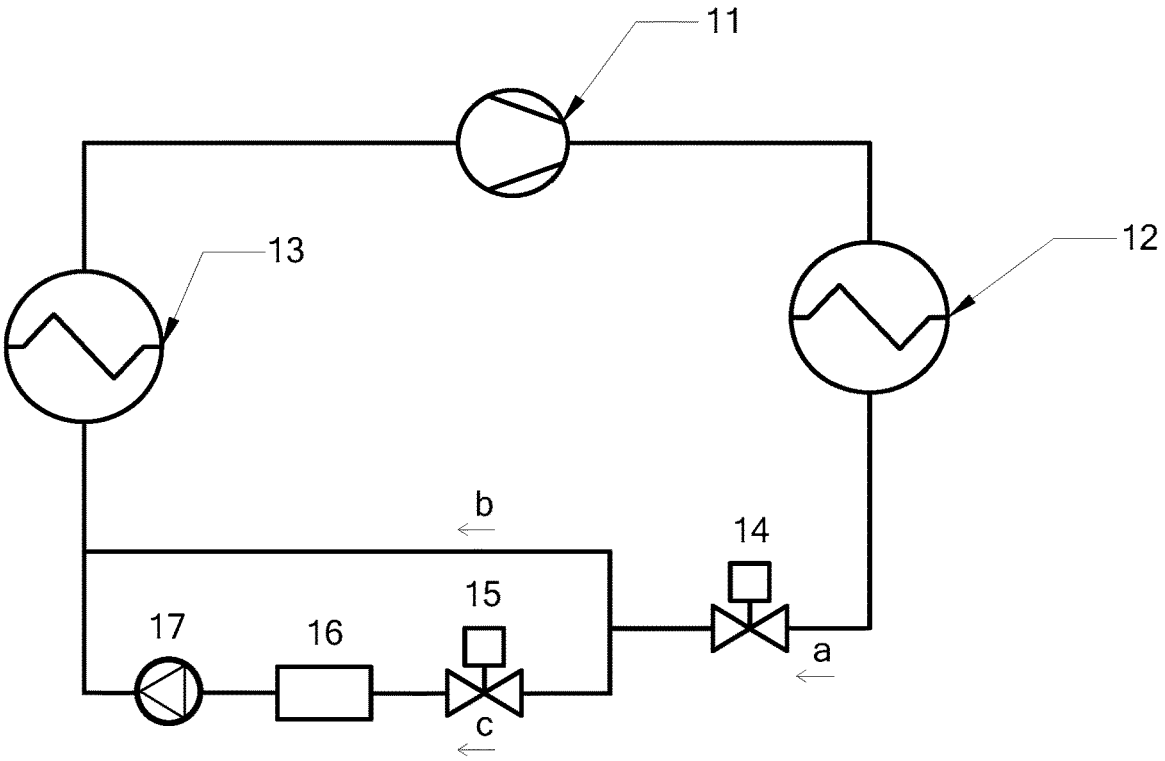
FIG. 4 is a structural schematic view of the high-temperature air conditioning device according to the third embodiment of the present disclosure.

Regarding the arrangement of the booster pipeline, two schemes are provided in this embodiment:

The first scheme: the inlet of the booster pipeline is connected to the outlet of the low-pressure pipeline, and the boosting device is a booster pump 17. The structures of two embodiments are shown in FIG. 2 and FIG. 4. Under the action of the booster pump 17, the low-temperature and low-pressure refrigerant flowing out of the components 16 to be cooled becomes medium-pressure, thereby smoothly entering the evaporator 13 to cycle.

Figure 5:
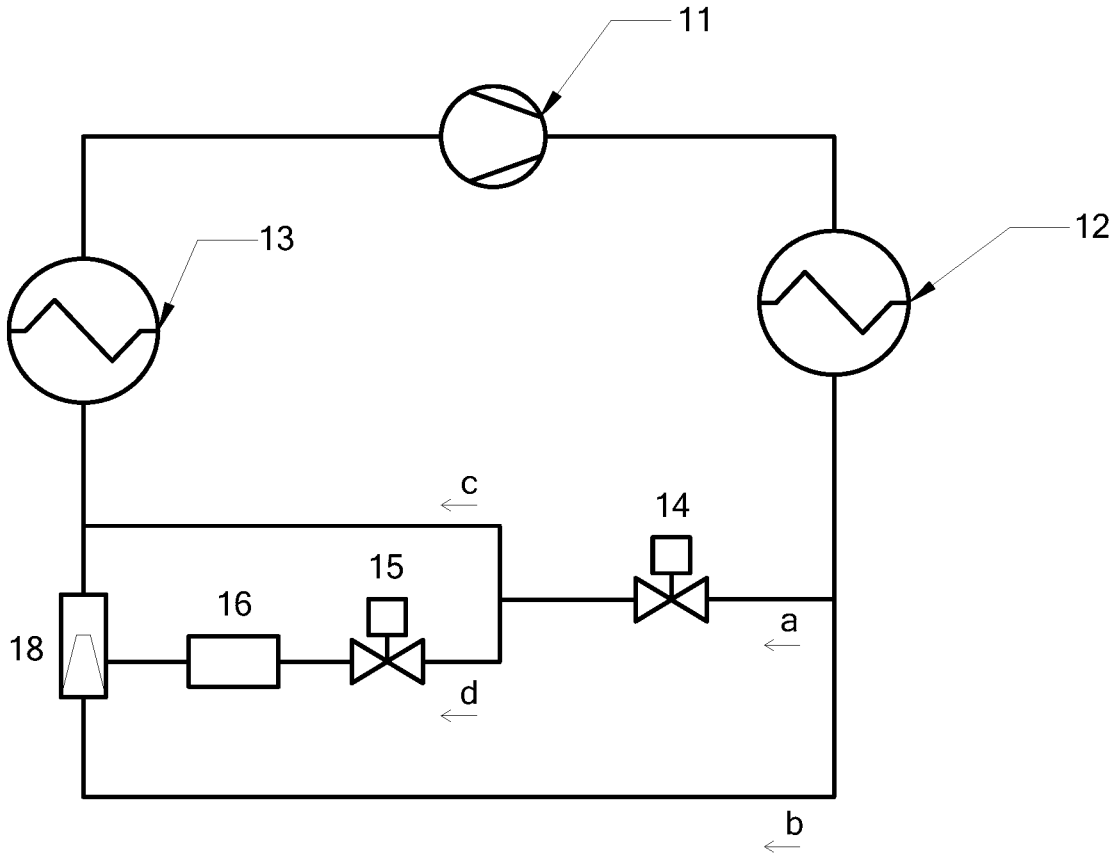
FIG. 5 is a structural schematic view of the high-temperature air conditioning device according to the fourth embodiment of the present disclosure.

The second scheme: the inlet of the booster pipeline is connected to the condenser 12; the boosting device is an ejector 18; the high-pressure end of the ejector 18 is connected to the condenser 12, and the low-pressure end of the ejector 18 is connected to the evaporator 13; the outlet of the low-pressure pipeline is connected to the ejecting end of the ejector 18. The structures of two embodiments are shown in FIG. 3 and FIG. 5. The high-temperature and high-pressure liquid refrigerant supplied by the condenser 12 drives the ejector 18 to suck the low-temperature and low-pressure refrigerant flowing out of the components 16 to be cooled, then together the refrigerant enters the medium-temperature and medium-pressure evaporator 13.

In some embodiments, the throttle valves and the booster pipeline are not limited to the above structures, and other embodiments may be adopted according to actual requirements; the pressure parameters of the throttle valves and the booster pipeline may also be determined according to specific conditions, and the pressure parameters are not limited herein.

Take the fourth embodiment of FIG. 5 as an example to further describe the scheme:

after the high-temperature and high-pressure liquid refrigerant flows out from the condenser 12, it is divided into two streams in the pipeline a and in the pipeline b respectively.

1. The high-temperature and high-pressure liquid refrigerant in the pipeline a is throttled by the first throttle valve 14 firstly, to become the medium-temperature and medium-pressure refrigerant, which is further divided into two streams in the pipeline c and in the pipeline d; and, the refrigerant in the pipeline c flows into the evaporator 13 to refrigerate; the refrigerant flowing in the pipeline d is throttled by the second throttle valve 15 secondly, and the throttled low-temperature and low-pressure refrigerant is drawn into the components 16 to be cooled (such as the frequency converter, the motor, the lubricating oil and so on) to cool.

2. The high-temperature and high-pressure liquid refrigerant in the pipeline b drives the ejector 18 to suck the low-temperature and low-pressure refrigerant flowing out from the components 14 to be cooled, then together the refrigerant flows into the medium-temperature and medium-pressure evaporator 13; the low-temperature and low-pressure gaseous refrigerant at the outlet of the evaporator 13 flows into the compressor 11 and is compressed to be high-temperature and high-pressure gaseous refrigerant, which flows into the condenser 12; and the cycle repeats.

In summary, the embodiments of the present disclosure provide a high-temperature air conditioning device, and more particularly, a high-temperature refrigerating device or a high-temperature heating pump device. By changing the arrangement mode of the throttle valves, the pressure of the refrigerant in the low-pressure pipeline can be lower than the pressure of the refrigerant in the medium-pressure line, thereby ensuring that the refrigerant in the low-pressure pipeline, which is used for cooling the components, is low-pressure, thereby solving the problem of insufficient cooling or non-cooling of the frequency converter, the motor, the lubricating oil, etc. caused by excessively high evaporation pressure in the high-temperature refrigerating device or in the high-temperature heating pump device in the prior art. The system has a simple structure and runs reliably. In one embodiment, by throttling the high-temperature and high-pressure liquid refrigerant flowing out of the outlet of the condenser, the low-temperature and low-pressure refrigerant is obtained to cool the frequency converter, the motor, the lubricating oil, etc.; simultaneously, the high-temperature and high-pressure liquid refrigerant drives the ejector to suck the low-temperature and low-pressure refrigerant that has cooled the frequency converter, the motor, the lubricating oil, etc., and sends the low-temperature and low-pressure refrigerant to return to the medium-temperature and medium-pressure evaporator.

The various embodiments in the present description are described one by one, and each embodiment is described focusing on its differences from other embodiments, and the same or similar parts of various embodiments may be referred one another.

What is claimed is:

1. A high-temperature air conditioning device, comprising a compressor, a condenser, a throttling and cooling pipeline assembly, and an evaporator, which are connected in sequence to form a cycle; wherein, the throttling and cooling pipeline assembly includes throttle valves, a medium-pressure pipeline, a low-pressure pipeline, and a booster pipeline; the throttle valves are configured to enable a pressure of refrigerant in the low-pressure pipeline to be lower than a pressure of refrigerant in the medium-pressure pipeline; the medium-pressure pipeline and the low-pressure pipeline are connected in parallel; components to be cooled are disposed in the low-pressure pipeline; an outlet of the low-pressure pipeline is connected to an inlet of the booster pipeline, and an outlet of the booster pipeline is connected to the evaporator; a booster pump is arranged in the booster pipeline;

the medium-pressure pipeline and the low-pressure pipeline are connected in parallel between the condenser and the evaporator;

the throttle valves include a first throttle valve disposed in the medium-pressure pipeline, and a plurality of second throttle valves connected in series in the low-pressure pipeline; a pressure regulation capacity of the plurality of second throttle valves connected in series is greater than a pressure regulation capacity of the first throttle valve; the components to be cooled are connected in series downstream of the plurality of the second throttle valves.

2. The high-temperature air conditioning device according to claim 1, wherein, the pressure adjustment capacity of each of the second throttle valves is identical.

3. The high-temperature air conditioning device according to claim 1, wherein, number of the second throttle valves is two.

4. A high-temperature air conditioning device, comprising a compressor, a condenser, a throttling and cooling pipeline assembly, and an evaporator, which are connected in sequence to form a cycle; wherein, the throttling and cooling pipeline assembly includes throttle valves, a medium-pressure pipeline, a low-pressure pipeline, and a booster pipeline; the throttle valves are configured to enable a pressure of refrigerant in the low-pressure pipeline to be lower than a pressure of refrigerant in the medium-pressure pipeline; the medium-pressure pipeline and the low-pressure pipeline are connected in parallel; components to be cooled are disposed in the low-pressure pipeline; an outlet of the low-pressure pipeline is connected to an inlet of the booster pipeline, and an outlet of the booster pipeline is connected to the evaporator; a booster pump is arranged in the booster pipeline;

the medium-pressure pipeline and the low-pressure pipeline are connected in parallel between the condenser and the evaporator;

the throttle valves include a first throttle valve disposed in the medium-pressure pipeline, and a second throttle valve disposed in the low-pressure pipeline; and a pressure regulation capacity of the second throttle valve is greater than a pressure regulation capacity of the first throttle valve.

5. A high-temperature air conditioning device, comprising a compressor, a condenser, a throttling and cooling pipeline assembly, and an evaporator, which are connected in sequence to form a cycle; wherein, the throttling and cooling pipeline assembly includes throttle valves, a medium-pressure pipeline, a low-pressure pipeline, and a booster pipeline; the throttle valves are configured to enable a pressure of refrigerant in the low-pressure pipeline to be lower than a pressure of refrigerant in the medium-pressure pipeline; the medium-pressure pipeline and the low-pressure pipeline are connected in parallel; components to be cooled are disposed in the low-pressure pipeline; an outlet of the low-pressure pipeline is connected to an inlet of the booster pipeline, and an outlet of the booster pipeline is connected to the evaporator; a booster pump is arranged in the booster pipeline;

the throttle valves include a first throttle valve and a second throttle valve;

the medium-pressure pipeline and the low-pressure pipeline are connected in parallel, and the first throttle valve is arranged between the condenser, and an inlet of the medium-pressure pipeline and the low-pressure pipeline;

the second throttle valve is disposed in the low-pressure pipeline.

* * * * *